US005504511A

United States Patent [19]

Nakajima et al.

[11] Patent Number: 5,504,511

[45] Date of Patent: Apr. 2, 1996

[54] INK CONTAINER

[75] Inventors: Kazuhiro Nakajima, Yokohama; Keiichiro Tsukuda, Kawasaki, both of Japan

[73] Assignee: Canon Kabushiki Kaisha, Tokyo, Japan

[21] Appl. No.: 63,682

[22] Filed: May 20, 1993

[30] Foreign Application Priority Data

May 22, 1992 [JP] Japan ..... 4-130691

[51] Int. Cl.[6] ..... B41J 2/175

[52] U.S. Cl. ..... 347/86; 347/87

[58] Field of Search ..... 346/140 R; 347/85, 347/86, 87

[56] References Cited

U.S. PATENT DOCUMENTS

| | | | |
|---|---|---|---|
| 3,953,862 | 4/1976 | Amberntsson | 346/140 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,760,409 | 7/1988 | Kiyohara et al. | 346/140 R |

FOREIGN PATENT DOCUMENTS

| | | |
|---|---|---|
| 0375383 | 6/1990 | European Pat. Off. . |
| 0529626 | 3/1993 | European Pat. Off. . |
| 57-024282 | 2/1982 | Japan . |
| 59-098857 | 6/1984 | Japan . |
| 59-123670 | 7/1984 | Japan . |
| 59-138461 | 8/1984 | Japan . |
| 60-206649 | 10/1985 | Japan . |
| 60-204355 | 10/1985 | Japan . |

*Primary Examiner*—Benjamin R. Fuller
*Assistant Examiner*—Valerie Ann Lund
*Attorney, Agent, or Firm*—Fitzpatrick, Cella, Harper & Scinto

[57] ABSTRACT

An ink container which contains ink to be supplied to a recording head comprises a housing constituting the outer housing of the ink container; a shiftable member arranged in the housing to contain ink and at the same time, being shiftable as the ink is consumed; and a guide member provided with an ink supply outlet to supply ink to a recording head from the inside of the shiftable member which contains the ink, and an ink guide outlet arranged at the end of the guide member which is extended to the end portion on the side opposite to the end side where the ink supply outlet is provided for guiding the ink from the inside of the shiftable member. With the structure thus arranged, it is intended to implement an ink container suitable for a small-sized ink jet printer or the like, which has a high application efficiency for a quality printing without any possibility of ink leakage irrespective of the posture in which it is used.

8 Claims, 11 Drawing Sheets

INK CONTAINER

BACKGROUND OF THE INVENTION

1. Field of the Invention

The present invention relates to an ink container. More particularly, the invention relates to an ink container employed for an ink jet recording or the like which uses a liquid ink.

2. Related Background Art

In recent years, an ink jet recording apparatus has been used more widely because of its quiet movement, higher speed, and other features.

In the so-called on-demand type ink jet recording apparatus where ink droplets are discharged in accordance with image signals, it is desirable to keep the ink in the vicinity of the discharging ports in a state of a negative pressure which is slightly lower than the atmospheric pressure in order to avoid any ink leakage from the discharging ports of the recording head when the printing operation is at rest, and at the same time, to discharge it stably as the correctly sized ink droplets when the printing is in operation.

A conventional method which is most widely used for the purpose of creating this state is shown in FIG. 1. FIG. 1 is a perspective view illustrating the arrangement of the ink container for a printer according to the prior art.

In FIG. 1, an ink container 91 is installed in the apparatus independent of the recording head 92 which is mounted on a carriage and connected to the apparatus by tubes 94. Then, the water level of the ink therein is always kept at a position lower than the discharging ports of the recording head 92; thus implementing the state of a negative pressure.

In recent years, however, demands on smaller printers have been more conspicuous, leading to the development of a printer having the mode where an ink container is mounted on a carriage together with a recording head 92 rather than the system where the tubes 94 are drawn around. A printer of the kind is being put to practical use. However, the method for generating the negative pressure by the utilization of the difference in water levels as described above is not applicable to the printer having such a mode. Moreover, as a printer is made smaller, there is a tendency that it is carried more. Hence, it is prerequisite that no ink leakage should occur irrespective of the posture in which the small printer is carried. In other words, a means for generating an appropriate negative pressure must be provided for the ink container.

As an ink container to meet such a demand as this, the following is known:

At first, a porous material is filled in an ink container. Ink is soaked in the porous material to generate a negative pressure by the force of fine meniscus formed in the porous material.

Also, the opening of a container is covered with a dome-shaped flexible material to maintain a negative pressure by the deformation of the flexible material in response to the negative pressure thus generated in the container as described above (disclosed in Japanese Patent Application Laid-Open No. 59-98857).

Also, there is an ink container in which a movable wall is provided. FIGS. 2A to 2C are side cross-sectional views showing a conventional ink container of the kind.

In FIGS. 2A to 2C, a movable wall 110 is arranged in an ink container 111. The movable wall is being shifted toward the ink outlet 104 side as the quantity of the ink 103 is reduced due to printing. In this way, the negative pressure exerted on the ink in the main body of the ink container 111 is controlled by the friction on the sliding plane between the movable wall 110 and the inner surface of the main body of the ink container 111. In this respect, for the movable wall in FIGS. 2A to 2C, there is among others a type for which an O ring 105 is provided on the sliding plane of the movable wall 110 as shown in FIG. 2A; a type for which a flexible material of a diaphragm configuration is used for the movable wall 110 as represented in FIG. 2B; and a type for which a gel 106 is used for sealing the sliding plane of the movable wall as shown in FIG. 2C as already-applied by the applicant hereof.

However, when a recording head and an ink tank are mounted on a carriage, the carriage must be built as small as possible while securing the number of prints as many as possible. In other words, it should desirably be attempted to maximize the quantity of usable ink against the containable volume of the ink container (hereinafter referred to as application efficiency). In the case of the above-mentioned conventional examples such as the use of a porous material to soak ink, and a provision of a dome-shaped flexible material, there is a problem that the application efficiency is not very high although each of them demonstrates a good preventive property for the ink leakage.

On the other hands, when the conventional examples shown in FIGS. 2A to 2C are used, the application efficiency is considerable good for all of them. However, it is difficult for the systems represented in FIGS. 2A and 2B to reduce the force of the sliding friction while enhancing the water-tightness against the ink on the sliding plane simultaneously. Particularly, it is difficult to implement them constantly. Here, the application of the gel to the sliding plane as shown in FIG. 2C results in an extreme ease with which to adjust the sliding friction force in the sliding plane of the movable wall.

In an ink container using a movable wall such as this, the negative pressure is generated by the sliding friction force of the movable wall while in printing. Therefore, the negative pressure thus generated is dynamic, and it does not act in such a case where the meniscus of the discharging ports of the recording head is broken among some other cases. As a result, if the ink outlet 104 shown in FIG. 2C is placed downward by the posture of the printer, a water head H is exerted directly on the recording head to make the pressure greater than a pressure which is exerted when the posture is such that the ink outlet is placed upward. In such a case, the negative pressure given to the head differs by each of the postures; thus making it difficult to obtain a constant ink discharging condition. Moreover, there is still a possibility that an ink leakage takes place if the meniscus is broken due to the dust particles or the like which should abut on the discharging ports of the recording head.

SUMMARY OF THE INVENTION

The present invention is designed to solve the problems encountered in the above-mentioned prior art. It is an object of the invention to provide an ink container suitable for a small-sized ink jet printer, having an excellent application efficiency without any possibility of ink leakage by maintaining a constant condition of the negative pressure irrespective of the postures, and also, being capable of an excellent printing irrespective of the postures.

In order to solve the above-mentioned problems, the present inventor et al have found after assiduous studies and discussions that for the relaxation of a stress which is concentrated by the posture on the ink outlet 104 which serves as the junction of the ink container 111 with the recording head, it is effective to provide a suction outlet in a region where the stress is least concentrated, that is, the side opposite to the ink outlet 104, so that the ink is guided from the end portion of such location when the ink outlet 104 is placed downward as shown in FIG. 2C.

In other words, a structure is arranged to provide an ink guide which is extended from the ink outlet to the ink suction outlet, and allow the ink in the ink container to be drawn out from the location which is the farthermost from the junction with the recording head.

It is desirable to adopt a structure in addition so that the ink which is positioned in a lower part is shifted to an upper part in order to achieve an excellent ink supply from the ink suction outlet which is installed in the upper part when the ink outlet 104 is placed downward as described above. The first step to achieve this is that the arrangement is made to enable an ink container to be shifted as the ink is being consumed. The second step is that the side opposite to the side where the ink suction outlet is installed is made a free end, and the arrangement is made to shift the container from the free end side.

If either one of the above-mentioned structural arrangements or both of them are satisfied depending on the posture, it is possible to achieve an excellent ink supply condition independent of the difference in the postures.

An ink container according to the present invention is designed on the basis of the knowledge as described above, and is characterized in that the container is provided with a housing constituting the outer housing of the ink container; a shiftable member arranged in the foregoing ink container to contain ink, at the same time, being capable of shifting itself as the ink is consumed; an ink outlet to supply ink to the recording head from the inside of the shiftable member containing the ink; and an ink guide outlet extendedly arranged in the end portion of the side opposite to the end portion where the foregoing ink outlet is provided so that the ink is guided from the inside of the foregoing shiftable member, and having an ink suction outlet at the end portion of the aforesaid side.

DETAILED DESCRIPTION OF THE PREFERRED EMBODIMENTS

Hereinafter, in conjunction with the accompanying drawings, the description will be made of the embodiments according to the present invention.

At first, using FIGS. 3A to 3C, a first embodiment of the present invention will be described.

Figure 3A:
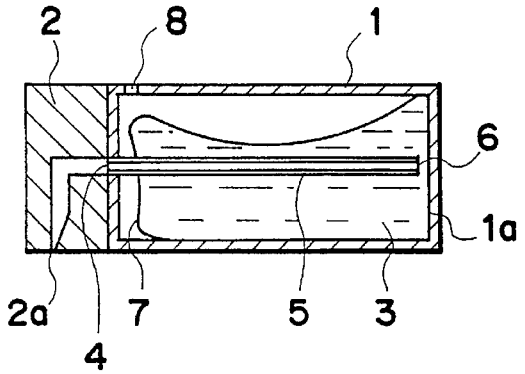
FIGS. 3A to 3C are side cross-sectional views showing an ink container according to a first embodiment of the present invention.
Figure 3B:
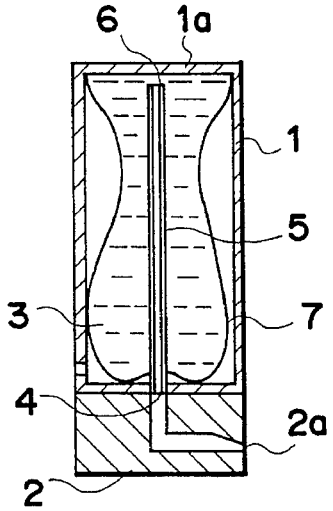
Figure 3C:
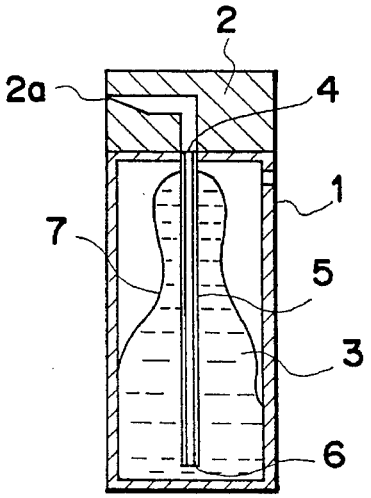

FIGS. 3A to 3C are views showing an ink container according to a first embodiment of the present invention, and in FIG. 3A, the container is represented as in a horizontal use where the ink guide tube is horizontally positioned; in FIG. 3B, as in a use where the ink outlet is placed downward and the ink suction outlet is positioned in the upper part; and in FIG. 3C, as in a use where the ink outlet is placed upward and the ink suction outlet is positioned in the lower part.

In FIGS. 3A to 3C, a reference numeral 1 designates an ink container; 2, a recording head; 3, ink; 4, an ink outlet which serves as means for drawing the ink 3 in the container 1 to let it out to the outside of the container; 5, an ink guide tube serving as means for letting in the ink 3 in the container 1 to guide it to the ink outlet 4; 6, an ink suction outlet which is the end portion of the ink guide tube 5 on the side opposite to the ink outlet 4, serving as means for sucking out the ink, and arranged in the container 1 on the side opposite to the ink outlet 4; 7, a bag serving as means of a movable partition and a displacing member to displace itself as the ink is consumed, which isolates the ink 3 in the container 1 from the atmospheric pressure; and 8, an air conduit hole serving as means for maintaining the atmospheric pressure to keep the inner pressure of the container 1 substantially equal to the atmospheric pressure.

The above-mentioned first embodiment will be described further in detail.

The ink container 1 and recording head 2 in FIGS. 3A to 3C are integrally coupled. In the ink container 1, the bag 7 which serves as a member of partition is fixed to the rear end of the ink container 1, that is, the ink suction outlet side, while the other end side is made a free end. Further, the ink guide tube 5 which guides the ink 3 to the recording head 2 is extendedly provided in the ink container, one end of which is open to the ink outlet 4 for supplying the ink to the recording head 2, and the ink suction outlet 6 which is the other end thereof is open in the vicinity of the rear end face of the ink container as shown in FIGS. 3A to 3C.

When the ink container 1 and recording head 2 are positioned almost horizontally as shown in FIG. 3A, the pressure exerted on the ink in the portion of the discharging port 2*a* of the recording head 2 is the atmospheric pressure or can be the one which is slightly pressurized. However, if the size of the ink container is approximately several centimeters long for a practical use, there is no possibility that an ink leakage occurs even when the meniscus of the discharging port 2*a* is broken due to the rigidity (the so-called firmness) that the bag material has more or less. Also, since no excessive water head is given, an excellent printing is possible in this posture.

Further, if the recording head is placed downward as shown in FIG. 3B, the ink 3 is in a state in the bag 7 as if it hangs from the rear end of the ink container. Therefore, the pressure exerted on the ink 3 in the portion of the discharging port 2*a* of the recording head 2 is almost the atmospheric pressure or in a negative state which is lower than the atmospheric pressure. As a result, no ink leakage from the discharging port occurs. Also, an excellent printing is possible in this posture, too.

When a posture allows the recording head 2 to be placed upward as shown in FIG. 3C, the ink 3 is displaced to the rear end side of the ink container 1 due to the gravity while the recording head 2 side is in a position which is correlatively higher. Therefore, there is no possibility that any ink leakage occurs. In this posture, too, an excellent printing is possible.

Now, still using FIGS. 3A to 3C, the description will be made of the first embodiment with emphasis on its operation.

In FIGS. 3A to 3C, the recording head 2 discharges ink droplets from the discharging port 2*a* by the well known principle of the ink jet recording. The discharge is executed by an electric signal transmitting means (not shown) in accordance with the image signals inputted to the recording head 2. This recording head 2 and ink container 1 are mounted on a carriage having a printer mechanism (which will be described later) and then, the printing is executed on a recording sheet.

In terms of the outer appearance as described earlier, there are provided for the ink container 1, the ink outlet 4 to feed the ink 3 to the recording head, and the atmospheric conduit hole 8 to induce the air into the ink container 1 in an amount corresponding to the amount of the ink which is consumed. The inner part of the ink container 1 comprises the ink guide tube 5 which is extended in the ink container 1 from the foregoing ink outlet 4 to the rear end at 1*a* of the ink container, and the bag 7 which serves to isolate the ink 3 in the ink container 1 from the air in the container. The bag 7 is water-tightly fixed to the surface of the rear end 1*a* of the ink container by means of flanges or the like and at the same time, fixed water-tightly to the outer periphery of the guide tube 5 in the vicinity of the ink outlet 4. The ink 3 is contained in the inside of the bag 7 as shown in FIGS. 3A to 3C, and the air outside the bag 7 is communicated with the atmosphere through the foregoing atmospheric conduit hole 8 to maintain its atmospheric pressure.

The dimensions of the ink container used in the first embodiment are 40 mm long, and a square column of 20 mm×20 mm at its cross-section. The recording head 2 has also almost the same cross-section and its length is 10 mm. The containable amount of ink is approximately 8 cc. Also, the number of the discharging ports 2*a* of the recording head 2 is 64, each in rectangular of 40 μm×45 μm. Also, as the material for the bag 7, a polyethylene of approximately 30 μm thick is used.

With this ink container and recording head, the printing is performed in each of the postures as described earlier. Then, a normal printing is possible to the end with any one of the postures in FIGS. 3A to 3C.

Furthermore, there is no ink leakage from the discharging ports in the usual condition. Also, the meniscus of the discharging ports 2*a* are intentionally broken by use of the needle which is allowed to slightly touch the discharging ports 2*a*, but no ink leakage takes place in any one of the postures in FIGS. 3A to 3C.

Subsequently, in conjunction with FIGS. 4A and 4B, the description will be made of a second embodiment of an ink container according to the present invention.

Figure 4A:
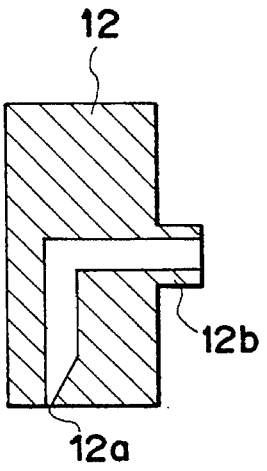
FIGS. 4A and 4B are side cross-sectional views showing an ink container according to a second embodiment of the present invention.
Figure 4B:
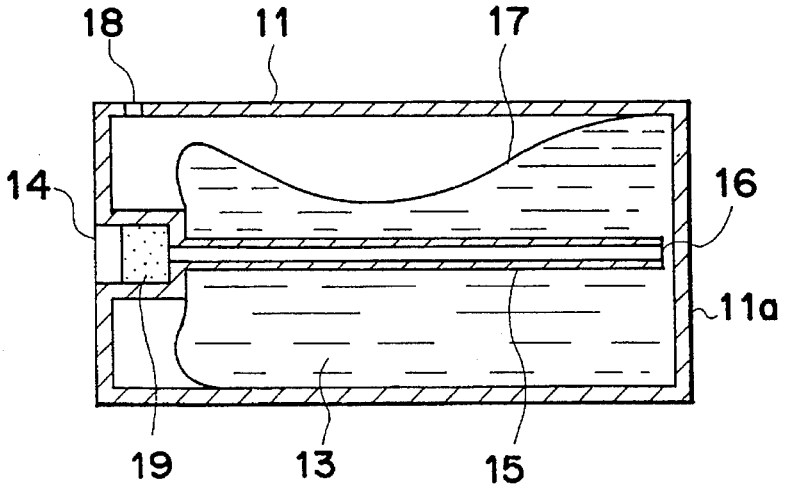

FIGS. 4A and 4B are side cross-sectional views illustrating an ink container according to the second embodiment of the present invention. The side cross-section of a recording head is shown in FIG. 4A. The side cross-section of an ink container is shown in FIG. 4B.

The difference between the second embodiment and the foregoing first embodiment is that whereas the recording head and ink container are integral in the first embodiment, a recording head 12 and an ink container 11 are detachable in the second embodiment.

In FIGS. 4A and 4B, the inside of the ink container 1 according to the second embodiment is structured substantially the same as that of the first embodiment, and the dimensions are also the same. Thus the ink container 11 in the second embodiment has a rear end 11a, and the structure includes an ink guide tube 15, an ink suction outlet 16, a bag 17 and an air conduit hole 18. What differs from the first embodiment is that a hollow coupling extrusion 12*b* is provided for the recording head 12 to make the recording head 12 and the ink container 11 detachable as described above, and an ink outlet 14 which is large enough to receive this extrusion 12*b* is arranged on the ink container 11 side. The hollow portion of the extrusion 12*b* is communicated with the discharging port 12*a* and is arranged to function as the ink supply passage. Further, in the ink outlet 14, a polyurethane porous member 19 is provided as shown in FIGS. 4A and 4B. The amount of the empty holes of this porous member 19 (the number of the empty holes per inch) is set at approximately 100 to 150 per inch when it is fitted into the ink outlet 14.

When the printing is performed in the same manner as the first embodiment using the ink container 11 and recording head 12, an excellent printing is possible in any one of the postures. Also, when the meniscus of the discharging ports 12*a* is broken, there is no ink leakage.

Further, when this ink container 11 is detached from the recording head 12, there is no leakage of the ink 13 from the Junction in any one of the postures. Moreover, the ink container 11 thus detached is again coupled to the recording head 12 for printing. Then, the printing is possible immediately.

In this respect, an ink container is fabricated without the foregoing porous member 19 for a trial in order to compare with the one according to the second embodiment. In this trial ink container, the air is sucked into the ink container from the ink outlet 14 when the ink container 11 is detached from the recording head 12, and the printing becomes impossible when it is intended again after recouping them because the supply of the ink is blocked. In other words, it has been found that when the structure is arranged to make the ink container 11 and recording head 12 detachable, the porous member 19 functions to prevent the outside air from entering the ink container through the ink outlet when the ink container is detached.

Subsequently, in conjunction with FIG. 5, the description will be made of a third embodiment according to the present invention.

Figure 5:
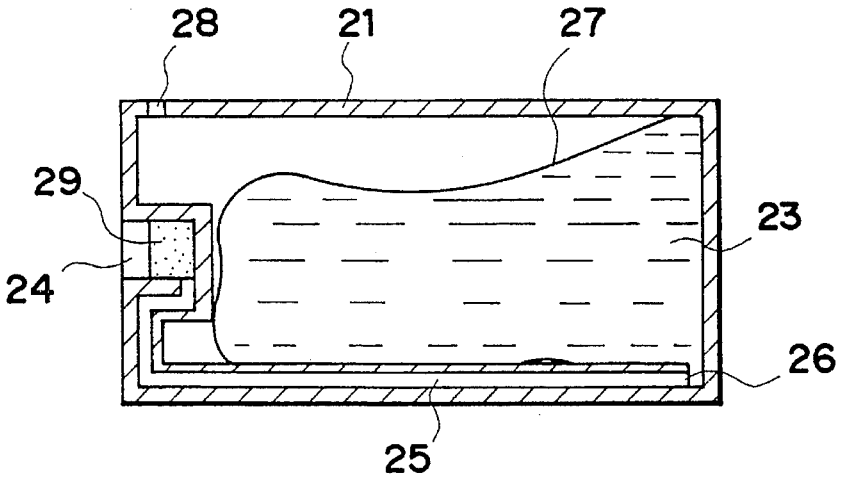
FIG. 5 is a side cross-sectional view showing an ink container according to a third embodiment of the present invention.

FIG. 5 is a side cross-sectional view illustrating an ink container according to the third embodiment of the present invention. The third embodiment is structured to make a recording head and an ink container detachable as the foregoing second embodiment. As clear from the second embodiment, the system is readily applicable to a case where the ink container and recording head are integral as in the foregoing first embodiment. Therefore, in the third embodiment, the description will be confined only to the ink container. The description of the recording head will be omitted.

In FIG. 5, an ink container 21 has an air conduit hole 28 and an ink outlet 24 with a porous member 29 provided therein, as in the second embodiment. The ink container 21 is arranged to allow ink 23 to be isolated by a bag 27 from the air as in the second embodiment, but in the third embodiment, an ink guide tube 25 is extended along the wall surface of the ink container 21 from the ink outlet 24 to the vicinity of the rear end of the ink container. The bag 27 is connected to the ink guide tube 25 in the part where the ink suction outlet 26 is present.

For the third embodiment, the same evaluations as in the second embodiment is made. The same actions and effects are obtained. In the third embodiment, when the bag 27 is fixed to the ink container 21, it is good enough to fix the bag only in the vicinity of the rear end surface of the ink container. Its fabrication is easier than the foregoing first and second embodiments, respectively.

Now, in conjunction with FIG. 6, the description will be made of a fourth embodiment according to the present invention.

Figure 6:
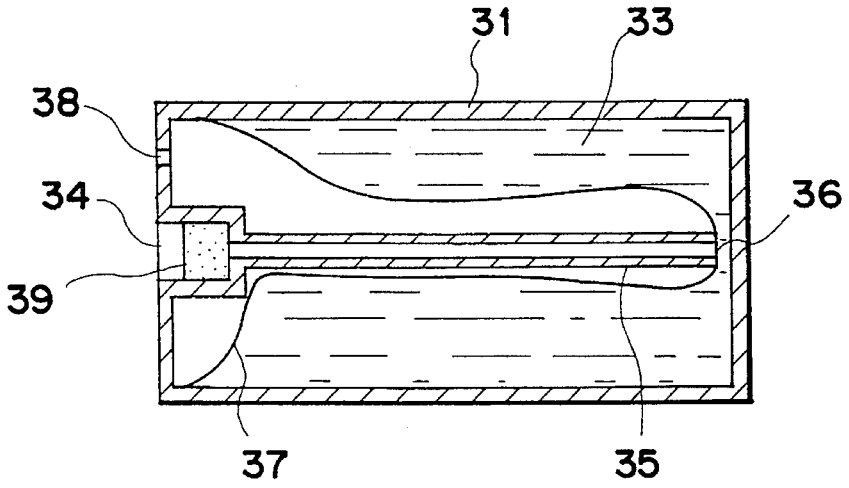
FIG. 6 is a side cross-sectional view showing an ink container according to a fourth embodiment of the present invention.

FIG. 6 is a side cross-sectional view illustrating an ink container according to the fourth embodiment of the present invention. The fourth embodiment is structured to make a recording head and ink container detachable as the foregoing third embodiment of the present invention. As in the foregoing embodiments, the ink container 31 has an air conduit hole 38 and an ink outlet 34 with a porous member 39 provided therein.

In FIG. 6, a bag 37 is fixed to the surface of the ink container 31 on the ink outlet 34 side by means of flange or the like, while the bag 37 is connected to the ink guide tube 35 which is extended to the vicinity of the rear end of the ink container 31 in a part where its ink suction outlet 36 is present. Ink 33 is contained outside the bag as shown in FIG. 6.

For the fourth embodiment, too, the same evaluations are made as in the foregoing third embodiment. The same actions and effects are obtained. In the fourth embodiment, when the bag 37 is fixed to the ink container 31, it is good enough to fix the bag only on the ink outlet 34 side of the ink container 31. Its fabrication is easier than the first and second embodiments.

Subsequently, the description will be made of a fifth embodiment according to the present invention in conjunction with FIG. 7.

Figure 7:
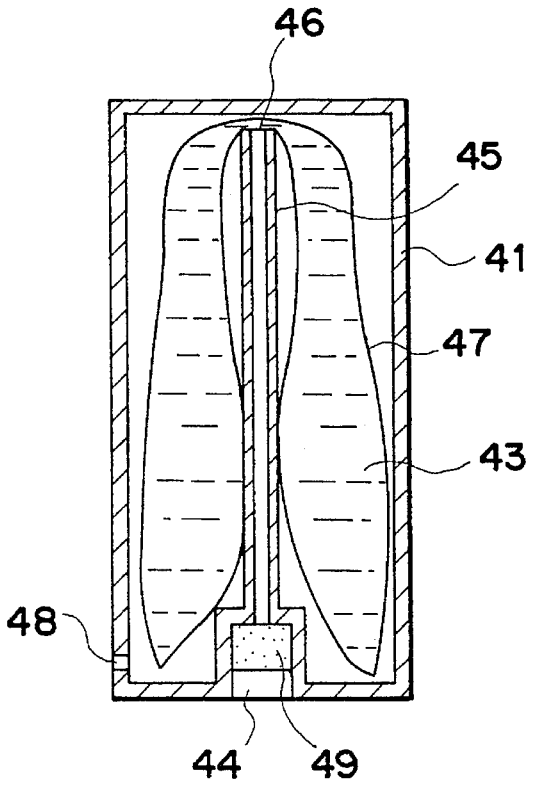
FIG. 7 is a side cross-sectional view showing an ink container according to a fifth embodiment of the present invention.
Figure 8:
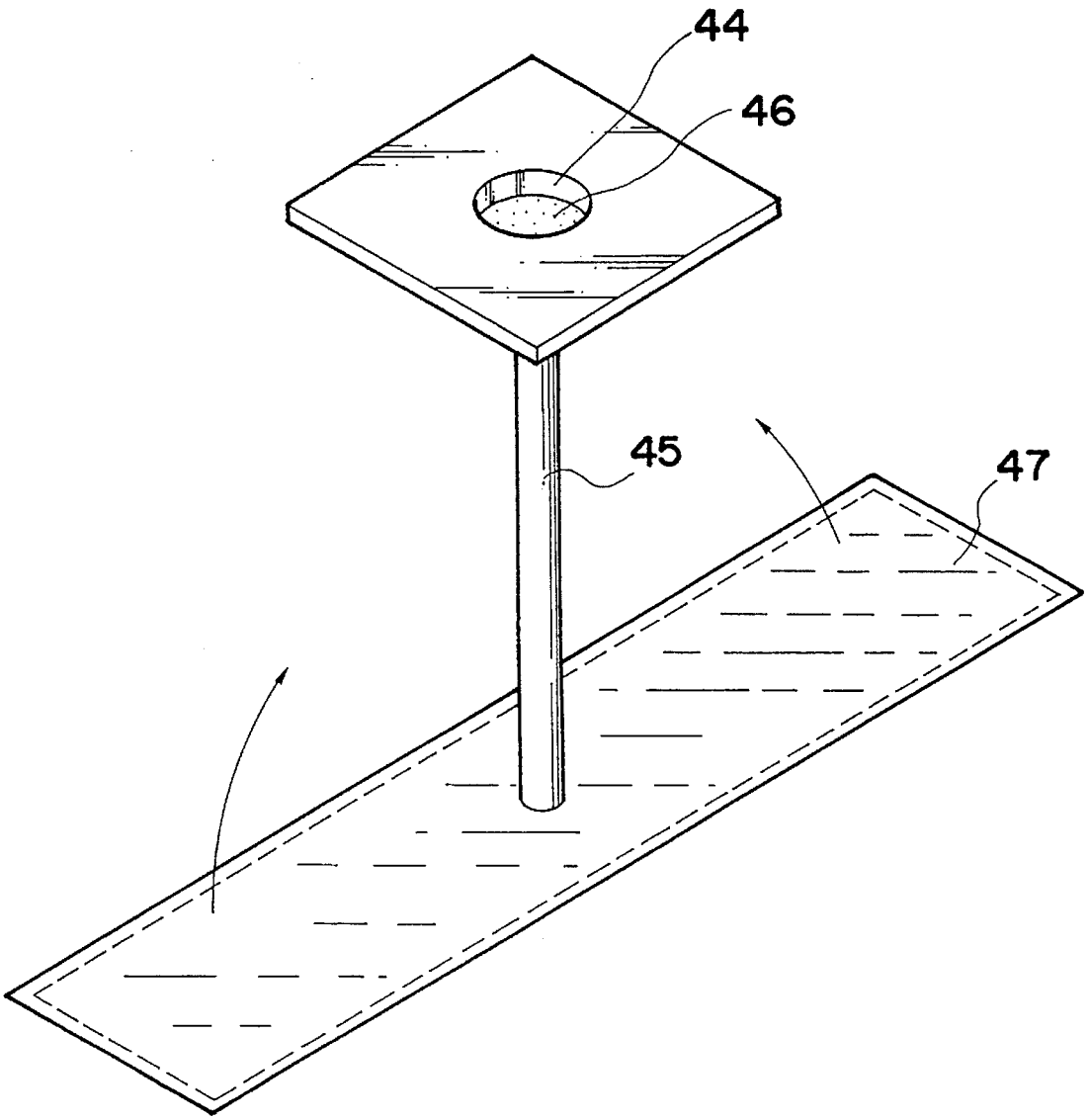
FIG. 8 is a perspective view illustrating a case where the ink container shown in FIG. 5 is fabricated.

FIG. 7 is a side cross-sectional view illustrating an ink container according to the fifth embodiment of the present invention. FIG. 8 is a view illustrating the way in which the ink container shown in FIG. 7 is assembled. As in the foregoing embodiments, the ink container 41 has an air conduit hole and an ink outlet 44 with a porous member 49 provided therein.

The fifth embodiment differs respectively from the foregoing first embodiment to the fourth embodiment. A bag 47 which contains ink 43 is not fixed to the ink container 41, but the bag 47 is fixed only to the ink suction outlet 46 which is one end of an ink guide tube 45 extended from the ink outlet 44.

For the fifth embodiment, too, the same evaluations as the second embodiment are made. The same actions and effects are obtained.

In the fifth embodiment, since the bag 47 is not fixed to the ink container 41, it will suffice if only an ink container 41 which is assembled as shown in FIG. 8 is installed in the outer housing of the ink container 41. Therefore, the fabrication will be easier.

Now, in conjunction with FIG. 9, the description will be made of a sixth embodiment according to the present invention.

Figure 9:
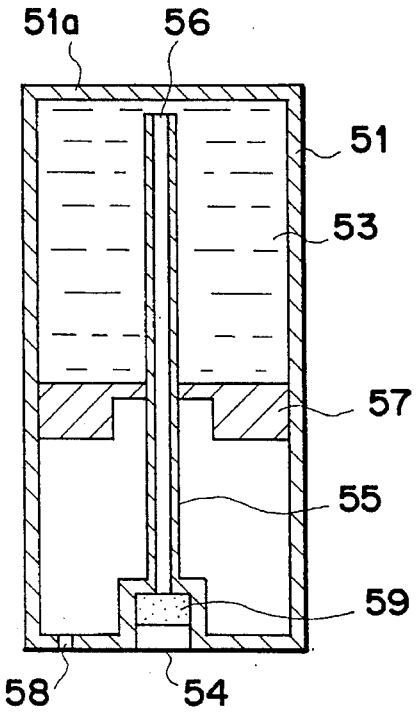
FIG. 9 is a side cross-sectional view showing an ink container according to a sixth embodiment of the present invention.

FIG. 9 is a side cross-sectional view illustrating an ink container according to the sixth embodiment of the present invention.

In FIG. 9, there are provided in an ink container 51 an ink outlet 54 and an ink guide tube 55 extended straightly therefrom as in the foregoing fourth and fifth embodiment, respectively. As in the foregoing embodiments, the ink container 51 has an air conduit hole 58 and an porous member 59 provided in the ink outlet 54. One end 56 of the ink guide tube 55 is open to the vicinity of the rear surface 51*a* of the ink container. Ink 53 is isolated from the air by a movable wall 57 which slides in the ink container 51. The ink guide tube 55 is inserted through a hole opened in the center of the movable wall 57.

Figure 1:
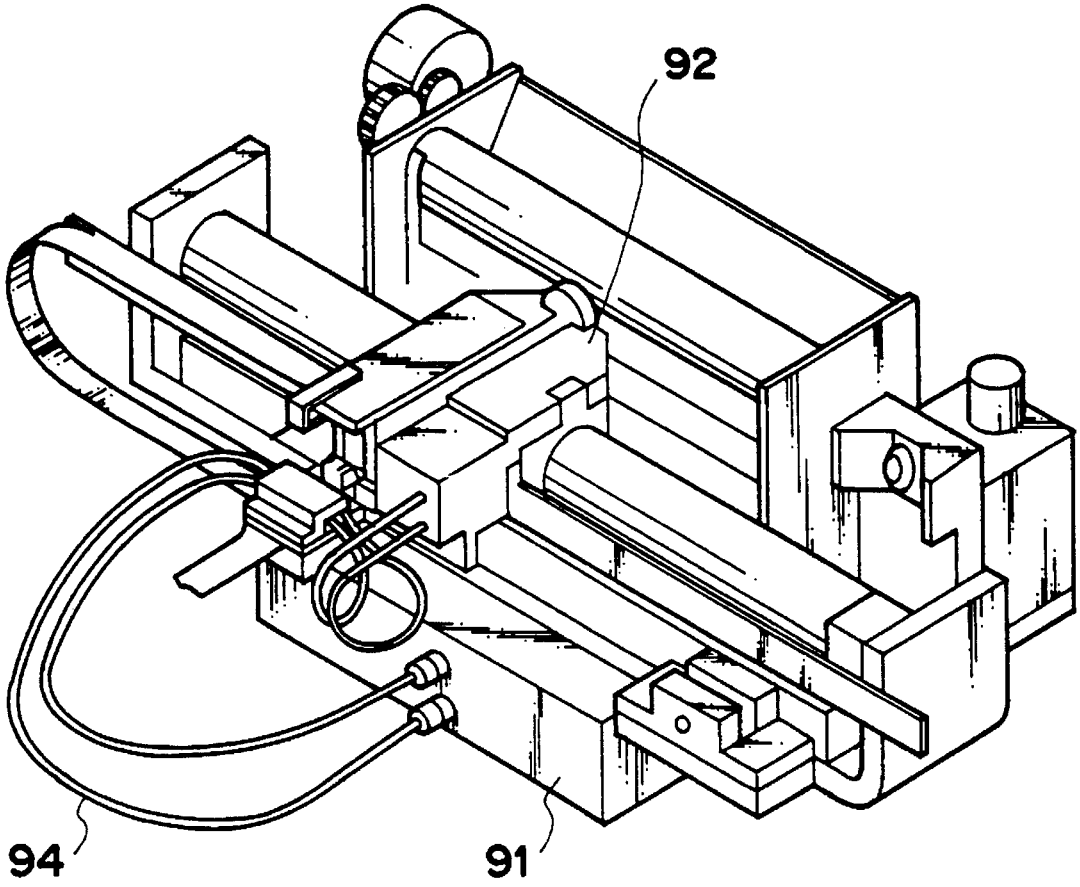
FIG. 1 PRIOR ART
FIG. 1 is a perspective view illustrating the arrangement of an ink container in a conventional printer.
Figure 2A:
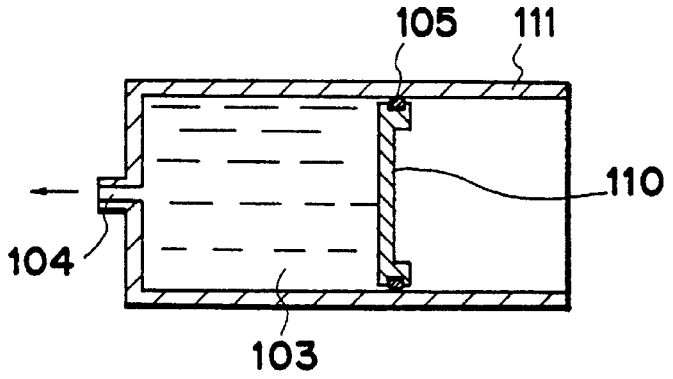
FIG. 2A PRIOR ART
FIGS. 2A to 2C are side cross-sectional views showing an ink container according to the prior art.
Figure 2B:
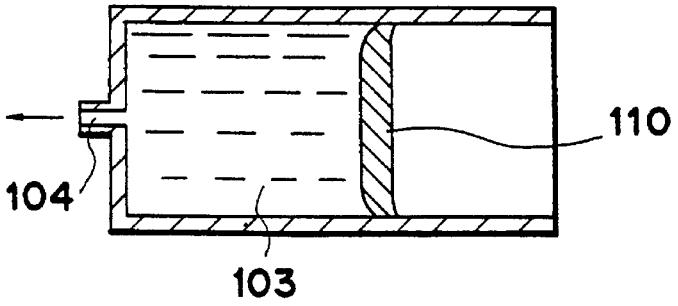
FIG. 2B PRIOR ART
Figure 2C:
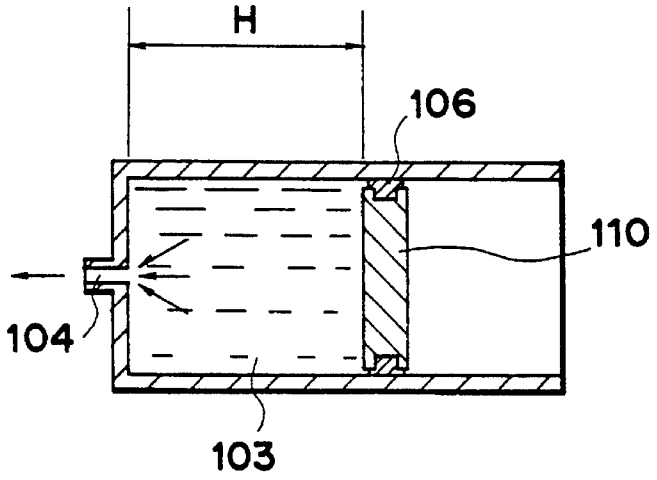
FIG. 2C PRIOR ART

It is required that the sliding plane between the movable wall 57 and the ink container 51, and the sliding plane between the movable wall 57 and the ink guide tube 55 are made water-tight against the ink and slidable with a lower friction. As means to serve such purposes, it is possible to apply the gel material shown in FIG. 2C illustrating the prior art to each of the sliding planes. In this respect, although the ink guide tube 55 can be made of a material having a high rigidity to establish its position exactly so as not to hinder the sliding of the movable wall 57, it is easier to design the system if the ink guide tube 55 is rather made of an extremely flexible material such as resin to allow it to follow the sliding.

For this ink container according to the sixth embodiment, too, the same evaluations are made as in the foregoing second embodiment. Substantially the same actions and effects are obtained. Also, in the sixth embodiment, there is a particular feature that it is easier to observe the remaining amount of the ink if the outer housing of the ink container is made of a transparent material.

Subsequently, in conjunction with FIG. 10, the description will be made of a seventh embodiment according to the present invention.

Figure 10:
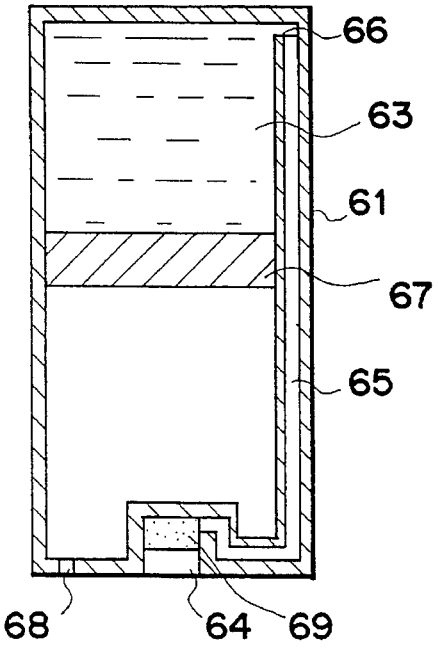
FIG. 10 is a side cross-sectional view showing an ink container according to a seventh embodiment of the present invention.

FIG. 10 is a side cross-sectional view illustrating an ink container according to the seventh embodiment of the present invention. In FIG. 10, the seventh embodiment uses a movable wall as in the sixth embodiment. However, a guide tube 65 does not penetrate a movable wall 67. It is extended along the inner wall of the ink container 61 to the rear end surface of the ink container. An ink suction outlet 66 is open to the vicinity thereof. The structure of the sliding planes, and others are the same as the sixth embodiment. Therefore, any repeated description thereof will be omitted.

For this ink container, too, the same evaluations are made as in the foregoing second embodiment. Substantially the same actions and effects are obtained. If the outer housing of the ink container according to the seventh embodiment is made of a transparent material, there is an advantage that it is easier to observe the remaining quantity of the ink 63. In addition, since there is no need for providing any through hole in the movable wall 67, its fabrication is still easier.

In this respect, while the description has been made of a case where one ink guide tube is employed in the above-mentioned first embodiment to seventh embodiment, its number is not limited thereto. There is no problem in providing two or more guide tubes. Also, the ink suction outlet is open to the vicinity of the surface on the side opposite to the ink outlet, but no exact position thereof is confined. Also, it may be possible to provide a filter for the ink suction outlet. With this filter, it is possible to prevent the recording head from being clogged due to dust particles in ink or from any other similar troubles as well as effectively prevent any air bubbles generated in ink from entering the guide tube in the ink container.

Now, in conjunction with FIG. 11, the description will be made of an ink jet recording apparatus to which an ink container according to the present invention is applicable.

Figure 11:
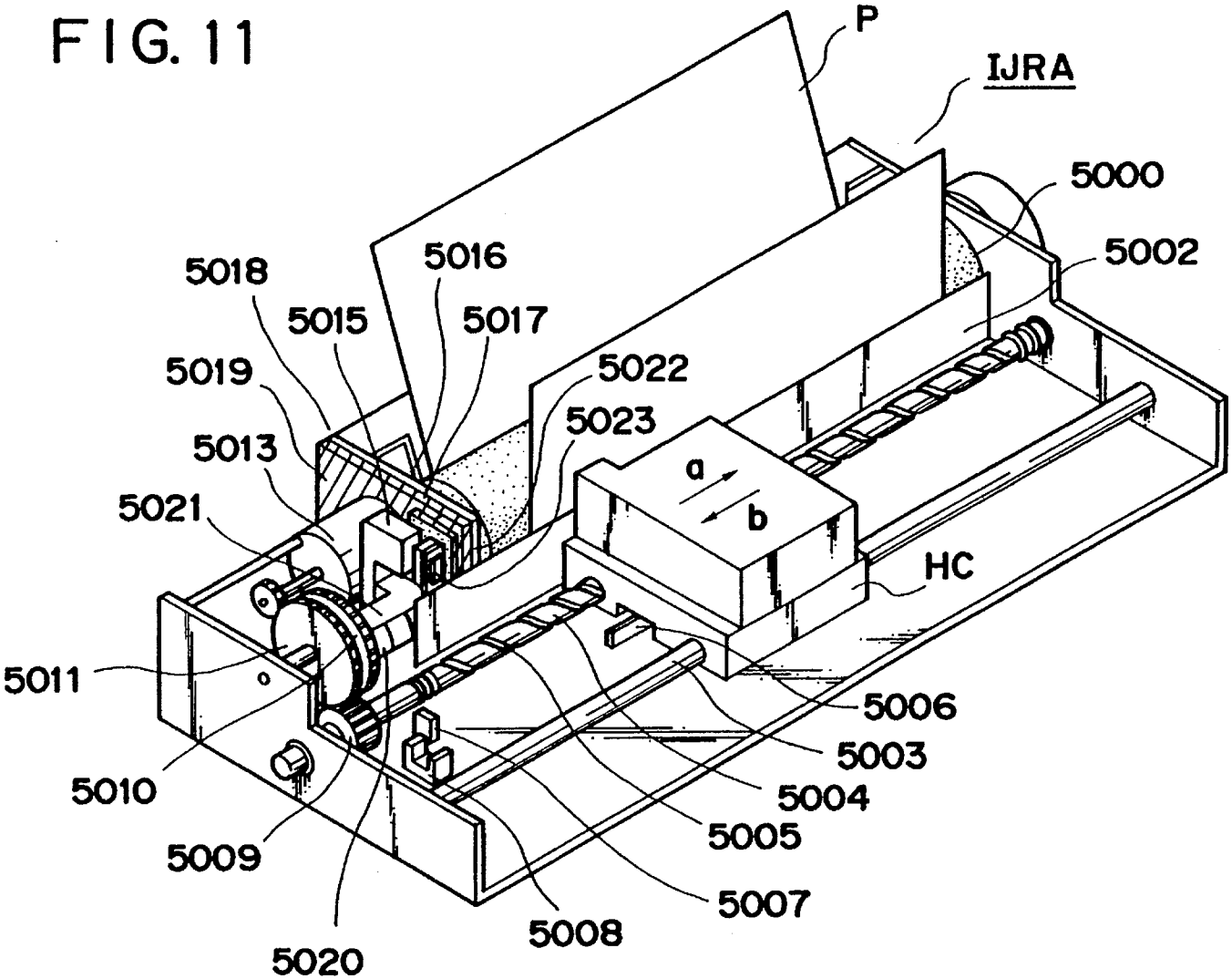
FIG. 11 is a perspective view showing the outer appearance of an ink jet recording apparatus to which the present invention is applicable.

FIG. 11 is a perspective view showing the outer appearance of an ink jet recording apparatus (IJRA) to which the present invention is applicable.

In FIG. 11, a carriage head carrier has a pin (not shown) and reciprocates in the directions indicated by arrows a and b as the carriage is coupled to the spiral groove 5004 of a lead screw 5005 rotative through the driving force transmission gears 5011 and 5009 which are interlocked with the normal or reverse rotation of a driving motor 5013. A reference numeral 5002 designates a sheet holding board to press the sheet to a platen (feed roller 5000 in the traveling direction of the carriage; 5007 and 5008, home position detecting sensors to switch the rotational direction of the motor 5013 among others by recognizing the presence of the carriage lever 5006 in this zone using photocouplers; 5016, a supporting member to support a capping member 5022 which caps the front end of the recording head; 5015, suction means to such the inside of this cap for the suction recovery of the recording head through an opening 5023 in the cap; 5017, a cleaning blade; and 5019, a member supported by a main body supporting board 5018 to enable this blade to move forward or backward. The blade is not necessarily limited to this mode. It is needless to mention that a known cleaning blade is also applicable to the present example. Also, a reference numeral. 5021 designates a lever for the actuation of the suction for the suction recovery: the lever travels along the movement of the cam 5020 which engages with the carriage, and its traveling is controlled by a known transmission means such as a clutch which controls the driving force from the driving motor.

A structure is arranged for the capping, cleaning, and suction recovery so that a desired process is executed in a position corresponding thereto by the action of the lead screw 5005 when the carriage arrives in a designated zone on the home position side. Any one of them is applicable to the present example if only desired actions are performed in a known timing. Each of the above-mentioned structures is an excellent invention whether it is observed singularly or complexly, and is preferably applicable to the present invention.

Subsequently, the description will be made of the structure and electric circuits of an information processing apparatus in which a recording apparatus according to the present invention is incorporated.

Figure 12:
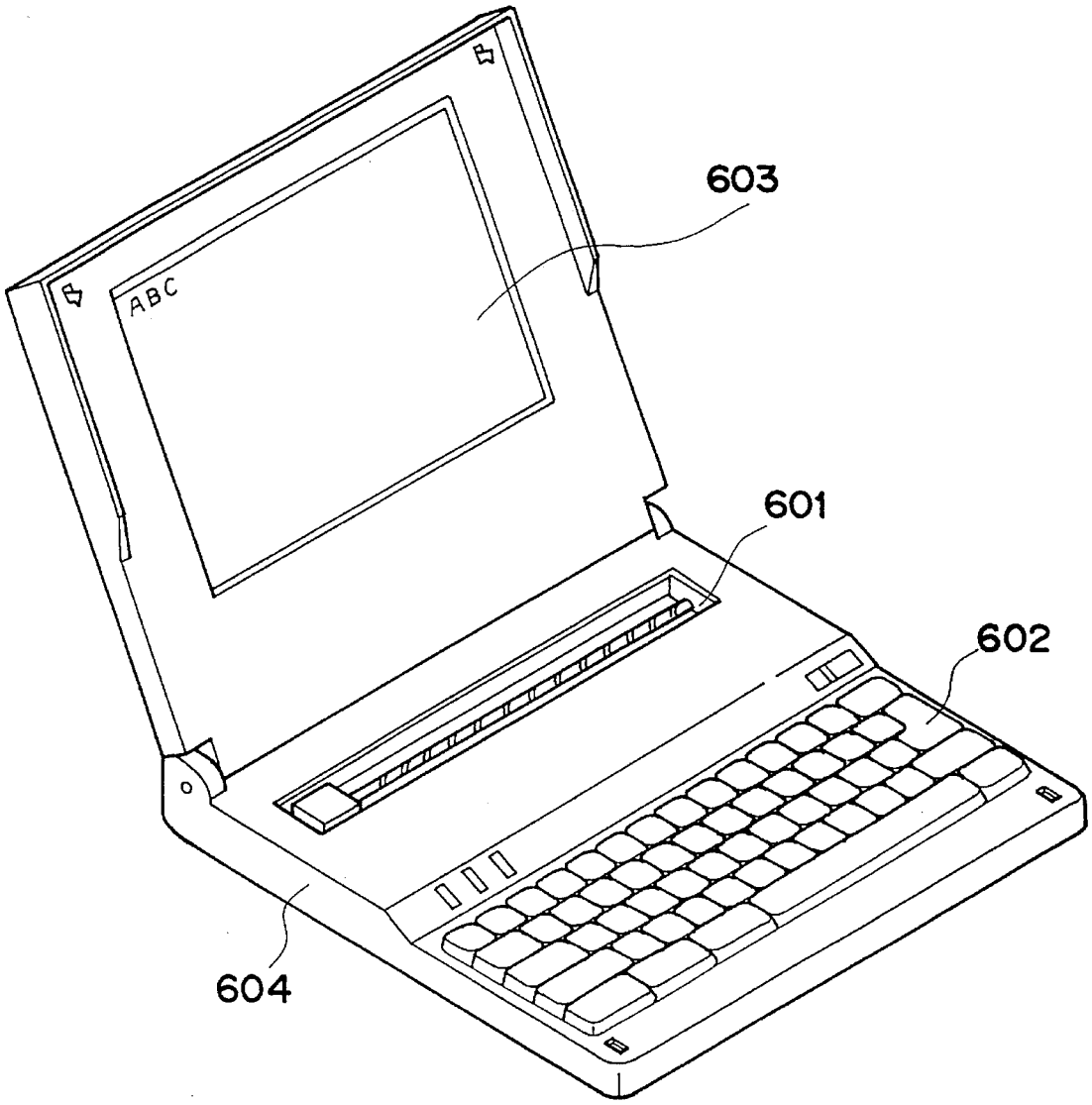
FIG. 12 is a perspective view schematically showing an information processing apparatus in which a recording apparatus according to the present invention is incorporated.

FIG. 12 is a perspective view schematically illustrating the outer appearance of an information processing apparatus 604 in which a recording apparatus according to the present invention is incorporated.

Figure 13:
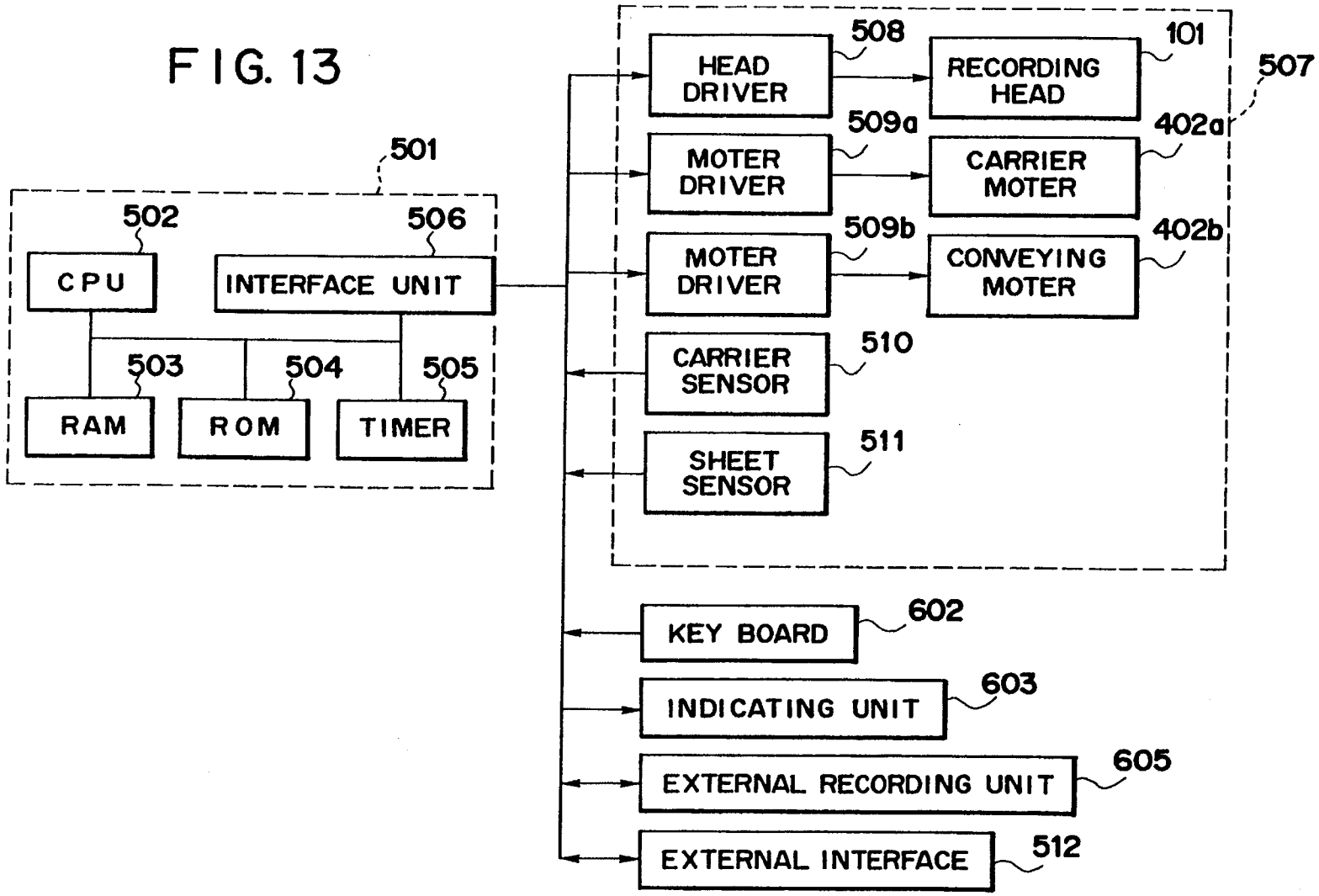
FIG. 13 is a block diagram showing the structure of electric circuits for an information processing apparatus according to the present embodiment.

In FIG. 12, a reference numeral 601 designates the above-mentioned printer unit; 602, a keyboard unit provided with keys for inputting letters, numerals, and other characters, and keys for issuing various instructions; and 603, a display unit provided with a displaying equipment. FIG. 13 is a block diagram representing the structure of the electric circuits for an information apparatus related to the present embodiment.

In FIG. 13, a reference numeral 501 designates a controller for the major control; 502, a CPU having a microcomputer configuration which executes certain procedures, for example; 503, a RAM provided with areas for the development of text data and image data and the operations thereof; 504, a ROM storing a program for the foregoing procedures and font data and other fixed data; 505, a timer to generate the execution cycles for the CPU 502 as well as the timing required for the recording operation by the printer unit 601; and 506, the interface which is arranged to connect signals from the CPU 502 to peripheral devices.

Also, a reference numeral 507 designates a controller for the printer unit 601; 508, a head driver to transfer recording signals, electric power, and others to the head cartridge 101; **509*a* and 509*b*, motor drivers to transfer the signals, electric power, and others required to drive a carrier motor 402*a* and a feed motor 402*b*, respectively; 510, a carrier sensor to detect the position of the carrier HC and determine whether the carrier HC is in the home position or not, for example; and 511**, a paper sensor, that is, a sheet sensor, to detect the presence of a recording medium P so as not to allow any recording to be executed in any locations other than the recording medium P when the recording medium P is yet to be set or the recording is completed to the end of a page.

Further, a reference numeral 605 designates an external storage such as an FDD, HDD, RAM, or the like; and 512, the external interface which is arranged for communicating with the other information processing apparatuses or controlling the peripheral devices through its direct connection to the respective inner bus.

In this respect, although not included in the block diagram shown in FIG. 13, there is provided a power source to supply electric power to the above-mentioned electric circuits. For the power source, there can be named a rechargeable battery, disposable dry cells, or an AC power adopter which is used when the main body of an information processing apparatus is used stationarily among others.

Figure 14:
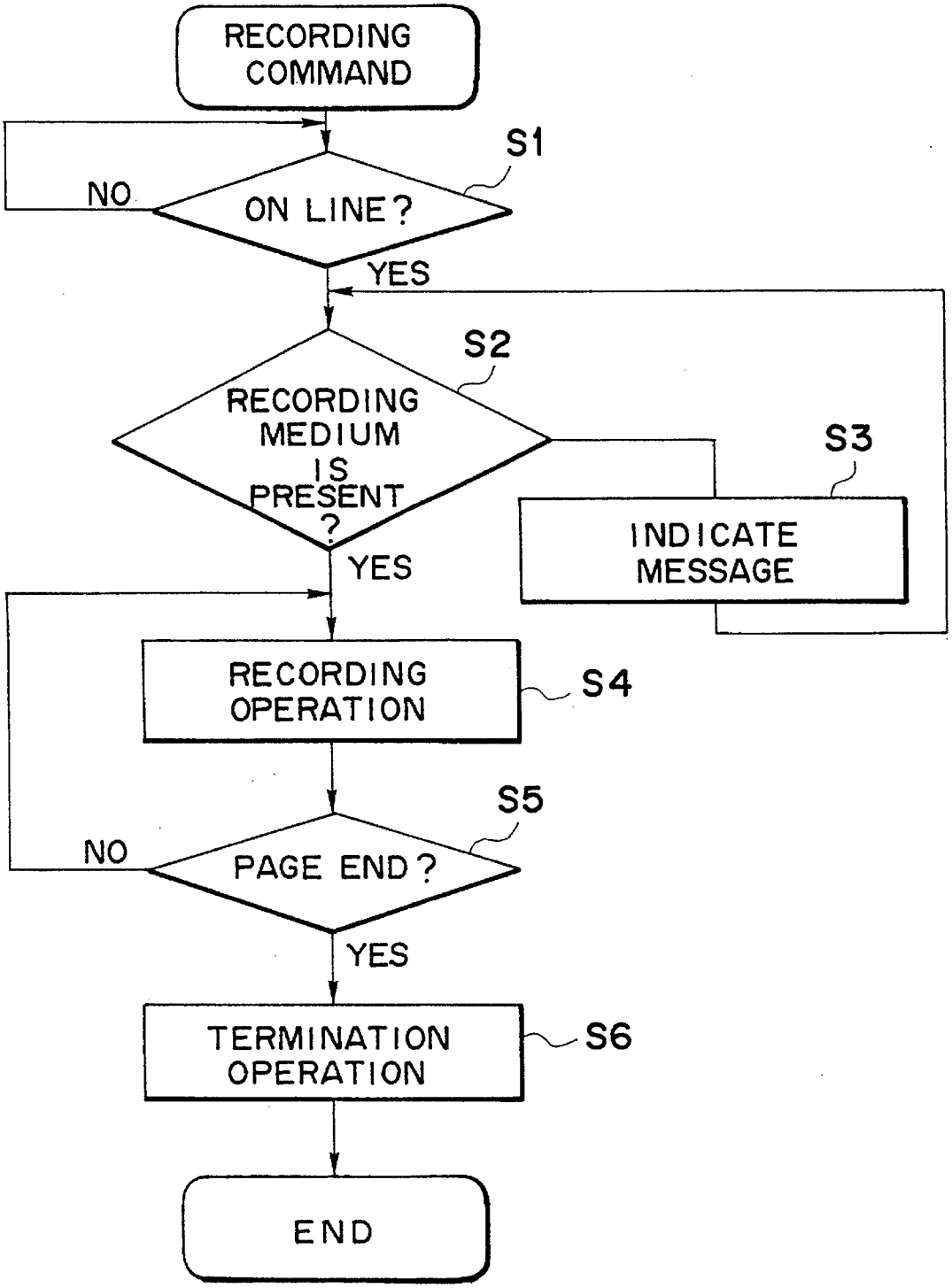
FIG. 14 is a flowchart showing the sequence of a recording operation according to the present embodiment.

With the electric circuits structured as above, the recording is performed on a recording medium P by the recording unit. Hereinafter, in conjunction with a flowchart shown in FIG. 14, the outline of the control sequence for the recording operation will be described.

A series of procedures given below is started when an instruction is issued to start recording through the recording instruction keys of the display operation unit of the printer main body or by an external device through the external interface.

At first, in step S1, whether the display operating unit is turned on or not is determined. This is a precautional step so as not to start any recording operation without any preparation on the printer side when an instruction to start the recording operation is issued from the outside mainly through communication or the like. Here, if the display operating unit is found to be in the on-line state, the sequence will proceed to step S2.

In the step S2, whether the recording medium P is set on the printer unit or not is determined by the signals from the paper sensor 511. This is a precautional step to prevent the ink from spreading in the printer to stain the apparatus itself or to prevent the ink which is also a recording medium from being wastefully consumed if any printing should be started without a recording medium particularly in a recording apparatus such as an ink jet printer.

Further, it may be possible to determine in this step S2 whether the pinch roller (not shown) and the feed roller 5000 are released or not in addition to the detection of the presence of the recording medium. This step is to prevent any abnormal feed of the recording medium because even when the recording medium P is set, its normal feed is impossible if the pinch roller is released. To determine whether the pinch roller is released or not, it may be possible to provide a mechanical switch for the release lever, for example. Here, if it is found that the recording medium is not set normally, the sequence will proceed to step S3.

In the step S3, a message is issued to call the attention of an operator so that the recording medium is set properly. Such a message can be issued by illuminating light in the display operating unit to represent the required message or buzzing for the message, for example.

Also, in the step S3, if the recording medium P is found to be properly set, the sequence will proceed to step S4.

In the step S4, the recording operation is started. The head driver 508 drives the head cartridge 101 in accordance with the instruction from the CPU 502. Also, in synchronism, the motor drivers 509*a* and 509*b* drive the carrier motor 402*a* and the feed motor 402*b* to execute printing with the traveling of the carrier 102 in the main scanning direction, the shifting of the recording medium in the sub-scanning direction, and the cleaning of the recording head 101 among others.

Lastly, in step S5, if the termination of the recording operation is instructed by the corresponding signal from the CPU 502, for example, or the printing has reached the last recording line number in the specific sub-scanning direction in one page, thus making it impossible to record any more on the recording medium, or the end of a recording area provision for the recording medium P is detected by the paper sensor 511, it is determined that the recording operation is terminated. It is then decided that the recording operation procedures are completed.

According to the terminating procedures on the recording operation in the step S6, the carrier HC is at first returned to the home position. This is required to cap the ink discharging ports of the recording head 101 for its protection in preparation for the occasion where the power source is turned off after the termination of the recording operation. Then, the feed motor 402*b* is driven for a given driving amount, for example, or the feed motor 402*b* is driven until the exhaustion of the recording medium P is recognized by the paper sensor 510 so that the recording medium is exhausted. Hence, the CPU 502 enables the display operating unit to indicate the termination of the recording or informs the peripheral devices of it through the external interface. Hence, the recording operation is completely terminated.

As described above, when a recording head and an ink container are detachable as in the present embodiment and an ink jet recording apparatus is arranged so that this detachment or attachment operation is executable in a state where the head and container are mounted on the carrier or demounted from the carrier, it is possible to obtain the effects given below.

In other words, since the ink container is mountable on the carrier, there is no need for providing the ink supply tubes and others; hence making it possible to make the apparatus small.

Also, when the ink is completely consumed, it is good enough to replace the ink containers only, not a cartridge which is formed integrally with a head. Thus, the running cost can be reduced.

Also, when either one of the recording head and the ink container must be replaced, only the one which needs the replacement can be replaced. Therefore, the economy of operation is improved.

Also, when the recording head and ink container are detached on the carrier by means of a lever or the like, the speed at which to draw them apart can be controlled. As a result, it is possible to prevent the ink from spreading out of the ink supply passage 12*b* and the ink outlet 14.

Also, the recording head and ink container are detached on the carrier, it is unnecessary to hold the recording head by hand directly. Hence, there is no possibility that the vicinity of the ink discharging ports of the recording head 101 is touched by hand. It is thus possible to avoid any unwanted contaminations that may produce an adverse effect on printing.

Also, when the recording head and ink container are detached on the carrier, the portion where the force of the ink container is exerted can be specified. It is, therefore, possible to arrange the structure so that only such a specific portion is made strong enough to withstand the force thus exerted thereon. Accordingly, the other portions can be thinned to make the container light and increase its containable volume. Also, if any exchange of ink colors is needed, the recording head and ink container can be replaced as an integrated body. There is no possibility that the ink colors are mixed. In addition, there is an effect that the required exchange can be made easily.

The present invention is the one which produces excellent effects on a recording head and a recording apparatus, particularly, on an ink jet recording apparatus provided with means for generating the thermal energy to change the state of ink thereby to utilize the energy thus generated for discharging ink for recording. With such a method as this, it is possible to attain a recording more precisely with a higher density.

Regarding the typical structure and operational principle of such a method, it is preferable to adopt those which can be implemented using the fundamental principle disclosed in the specifications of U.S. Pat. Nos. 4,723,129 and 4,740,796. This method is applicable both to the so-called on-demand type recording system and a continuous type recording system. Particularly, however, it is suitable for the on-demand type system because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with a remarkably quick response.

The driving signal in the form of pulses is preferably such as disclosed in the specifications of U.S. Pat. Nos. 4,463,359 and 4,345,262. In addition, the temperature increasing rate of the heating surface is preferably such as disclosed in the specification of U.S. Pat. No. 4,313,124 for an excellent recording in a better condition.

The structure of the recording head may be as shown in each of the above-mentioned specification wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also effective for the present invention. In addition, the present invention is effective for the structure disclosed in Japanese Patent Application Laid-Open No. 59-123670 wherein a common slit is used as the discharging ports for plural electrothermal transducers, and also for the structure disclosed in Japanese Patent Application Laid-Open No. 59-138461 wherein an opening for absorbing the pressure wave of the thermal energy is formed corresponding to the discharging ports.

Also, it is preferable to add the recording head recovery means and preliminarily auxiliary means which can be provided as constituents of a recording apparatus because with such an additional provision the effects of the present invention become more stable. To name such constituents specifically, there are capping means for the recording head, cleaning means, compression or suction means, preliminary heating means such as electrothermal transducers or heating elements other than such transducing type or the combination of those types of elements, and the preliminary discharge mode besides the regular discharge for recording.

As regards the kind and number of the recording heads mountable on the carriage, it may be a single color ink, or may be plural heads corresponding to a plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Also, the present invention is effective for an ink jet method using a recording head which is arranged in a state where it is not in contact with a recording medium and the recording is made by discharging ink onto it such as a piezo-jet method wherein electricity is transduced into a force required to discharge the ink for recording.

Furthermore, as modes of a recording apparatus according to the present invention, a copying apparatus combined with a scanner or the like or a facsimile apparatus having transmitting and receiving functions may be employed in addition to those used as an image output terminal of an information processing apparatus such as a word processor, a computer, or the like.

As set forth above, according to the present invention, it is possible to implement an ink container suitable for a small-sized ink jet printer or the like and capable of executing an excellent printing irrespective of any postures with a good application efficiency without any possibility of ink leakage irrespective of the postures.

What is claimed is:

1. An ink container containing ink to be supplied to a recording head, the container comprising:

a housing constituting an outer housing of said ink container;

a movable wall member arranged in said housing to contain the ink and be shiftable as the ink is consumed; and a guide member disposed in said housing and having an ink supply outlet for supplying the ink from inside chamber bounded by a wall including said movable wall member to a recording head, said guide member being extended to an end portion thereof having an ink guide outlet and being disposed in said housing remote from said ink supply outlet for guiding the ink from inside the ink chamber to said ink supply outlet, wherein said movable wall member shifts from a location proximate to said ink supply outlet to a location proximate to a side of said housing near which said ink guide outlet is disposed as the ink is consumed.

2. An ink container according to claim 1, wherein a porous member is provided on said ink supply outlet.

3. An ink container according to claim 1, wherein said ink container is provided integrally with the recording head.

4. An ink container according to claim 1, wherein said ink container is attachable to and detachable from the recording head.

5. A recording apparatus comprising:

a recording head for discharging ink;

conveying means for conveying a recording medium;

an ink container containing ink to be supplied to said recording head and having:

a housing constituting an outer housing of said ink container, a movable wall member arranged in said housing to contain the ink and be shiftable as the ink is consumed, and a guide member disposed in said housing and having an ink supply outlet for supplying the ink from inside an ink chamber bounded by a wall including said movable wall member to said recording head, said guide member being extended to an end portion thereof having an ink guide outlet and being disposed in said housing remote from said ink supply outlet for guiding the ink from inside the ink chamber to said ink supply outlet, wherein said movable wall member shifts from a location proximate to said ink supply outlet to a location proximate to a side of said housing near which said is guide outlet is disposed as the ink is consumed; and a carriage for mounting said recording head and said ink container.

6. An ink container having an ink supply outlet and an air conduit port, the container comprising:

a housing;

a shiftable member provided in said housing to divide an inside of said housing into an ink containing portion and an air communicating portion communicating with an outside air through said air conduit port; and a tubular guide member communicating said ink supply outlet with said ink containing portion and having an ink suction outlet for feeding the ink to said ink supply outlet;

wherein said guide member extends to said ink containing portion through said air communicating portion, and said ink suction outlet is disposed proximate to an inner surface opposite to said ink supply outlet.

7. A recording apparatus comprising:

a recording head for ejecting ink;

an ink container for supplying thee ink to said recording head, said ink container including an ink supply outlet;

an air conduit port;

a housing;

a shiftable member provided in said housing to divide an inside of said housing into an ink containing portion and an air communicating portion communicating with an outside air through said air conduit port;

a tubular guide member communicating said ink supply outlet with said ink containing portion and having an ink suction outlet for feeding the ink to said ink supply outlet, wherein said guide member extends to said ink containing portion through said air communicating portion and said ink suction outlet is disposed proximate to an inner surface opposite to said ink supply outlet;

a carriage for carrying said recording head and said ink container; and feeding means for feeding a recording material to face said recording head.

8. An ink container having an ink supply outlet and an air conduit port, the container comprising:

an ink containing portion;

an air communicating portion communicating with an outside air through said air conduit port;

a shiftable member provided in said ink container to divide said ink containing portion and said air communicating portion; and a tubular guide member communicating said ink supply outlet with said ink containing portion and having an ink suction outlet for feeding the ink to said ink supply outlet, wherein said guide member extends to said ink containing portion through said air communicating portion and said ink suction outlet is disposed proximate to an inner surface opposite to said ink supply outlet.

* * * * *

UNITED STATES PATENT AND TRADEMARK OFFICE

CERTIFICATE OF CORRECTION

PATENT NO. : 5,504,511

DATED : April 2, 1996

INVENTOR(S) : KAZUHIRO NAKAJIMA, ET AL.

It is certified that error appears in the above-identified patent and that said Letters Patent is hereby corrected as shown below:

COLUMN 1

Line 32, "92;" should read --92,--.

COLUMN 2

Line 12, "already-applied" should read --already applied--;

Line 26, "hands," should read --hand,--;

Line 28, "considerable" should read --considerably--; and

Line 49, "postures." should read --postures,--.

COLUMN 6

Line 48, "Junction" should read --junction--.

COLUMN 7

Line 62, "hole" should read --hole 48--.

UNITED STATES PATENT AND TRADEMARK OFFICE

CERTIFICATE OF CORRECTION

PATENT NO. : 5,504,511

DATED : April 2, 1996

INVENTOR(S) : KAZUHIRO NAKAJIMA, ET AL.

It is certified that error appears in the above-identified patent and that said Letters Patent is hereby corrected as shown below:

COLUMN 9

Line 24, "carriage head carrier" should read --carriage (head carrier) HC--;

Line 31, "(feed roller" should read --(feed roller)--;

Line 38, "such" should read --suck--; and

Line 45, "numeral." should read --numeral--.

COLUMN 11

Line 17, "the" (first occurrence) should be deleted;

Line 22, "the" (first occurrence) should be deleted;

Line 25, "the" (first occurrence) should be deleted; and

Line 45, "the" (first occurrence) should be deleted.

UNITED STATES PATENT AND TRADEMARK OFFICE

CERTIFICATE OF CORRECTION

PATENT NO. : 5,504,511

DATED : April 2, 1996

INVENTOR(S) : KAZUHIRO NAKAJIMA, ET AL.

It is certified that error appears in the above-identified patent and that said Letters Patent is hereby corrected as shown below:

COLUMN 13

Line 8, "specification" should read --embodiments--.

COLUMN 14

Line 2, "inside" should read --inside an ink--;

Line 44, "is" (first occurrence) should read --ink--; and

Line 66, "thee" should read --the--.

SHEET 10

Figure 13, "MOTER" (four occurrences) should read --MOTOR--.

Signed and Sealed this

First Day of October, 1996

Bruce Lehman

*Attest:*

BRUCE LEHMAN

*Attesting Officer*

*Commissioner of Patents and Trademarks*